US008975996B2

(12) United States Patent
Sakai et al.

(10) Patent No.: US 8,975,996 B2
(45) Date of Patent: Mar. 10, 2015

(54) ELECTRONIC COMPONENT AND METHOD OF MANUFACTURING THE SAME

(71) Applicant: Murata Manufacturing Co., Ltd., Kyoto (JP)

(72) Inventors: Satoki Sakai, Nagaokakyo (JP); Keishiro Amaya, Nagaokakyo (JP); Eita Tamezawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 13/766,379

(22) Filed: Feb. 13, 2013

(65) Prior Publication Data

US 2013/0222105 A1 Aug. 29, 2013

(30) Foreign Application Priority Data

Feb. 23, 2012 (JP) ..... 2012-037547

(51) Int. Cl.
*H01F 5/00* (2006.01)
*H01F 27/28* (2006.01)
*H01F 17/00* (2006.01)

(52) U.S. Cl.
CPC ..... *H01F 5/003* (2013.01); *H01F 17/0013* (2013.01); *H01F 2017/002* (2013.01)
USPC ..... 336/200; 336/232

(58) Field of Classification Search
USPC ..... 336/200, 232
See application file for complete search history.

(56) References Cited

U.S. PATENT DOCUMENTS

| | | | | |
|---|---|---|---|---|
| 5,515,022 | A * | 5/1996 | Tashiro et al. | 336/200 |
| 7,119,649 | B2 | 10/2006 | Shinkai et al. | |
| 8,193,894 | B2 | 6/2012 | Miyoshi et al. | |
| 2006/0158301 | A1 * | 7/2006 | Shinkai et al. | 336/232 |

(Continued)

FOREIGN PATENT DOCUMENTS

| | | | |
|---|---|---|---|
| JP | H02-072577 | U | 6/1990 |
| JP | H03-052288 | A | 3/1991 |

(Continued)

OTHER PUBLICATIONS

An Office Action; "Notice of Preliminary Rejection," issued by the Korean Intellectual Property Office on Jan. 17, 2014, which corresponds to Korean Patent Application No. 10-2013-0014839 and is related to U.S. Appl. No. 13/766,379.

(Continued)

*Primary Examiner* — Tsz Chan
(74) *Attorney, Agent, or Firm* — Studebaker & Brackett PC

(57) ABSTRACT

Provided is an electronic component that can suppress the occurrence of disconnections between line conductor layers and via hole conductors and a method of manufacturing the electronic component. A multilayer body is formed by stacking insulating layers. A conductor layer is provided on a first insulating layer. A line conductor layer is provided on a second insulating layer that is provided on an upper side of the first insulating layer in a stacking (z-axis) direction. A via hole conductor connects an end portion of the line conductor layer to the conductor layer and extends through the second insulating layer in the z-axis direction. In the via hole conductor, a connection surface connected to the line conductor layer is formed of a circular portion and a protrusion. The protrusion protrudes from the circular portion in the x-axis direction in which the line conductor layer extends from the end portion.

4 Claims, 8 Drawing Sheets

(56) References Cited

U.S. PATENT DOCUMENTS

| | | | | |
|---|---|---|---|---|
| 2010/0253464 | A1* | 10/2010 | Miyoshi et al. | 336/200 |
| 2011/0102124 | A1* | 5/2011 | Matsushita | 336/200 |

FOREIGN PATENT DOCUMENTS

| | | | |
|---|---|---|---|
| JP | H03-054884 | A | 3/1991 |
| JP | H06-132407 | A | 5/1994 |
| JP | 11-251144 | A | 9/1999 |
| JP | 2000-236157 | A | 8/2000 |
| JP | 3197022 | B2 * | 8/2001 |
| KR | 10-2006-0035785 | A | 4/2006 |
| KR | 10-2010-0110261 | A | 10/2010 |
| WO | 2010/007858 | A1 | 1/2010 |

OTHER PUBLICATIONS

An Office Action; "Notice of Allowance," issued by the Korean Intellectual Property Office on May 26, 2014, which corresponds to Korean Patent Application No. 10-2013-0014839 and is related to U.S. Appl. No. 13/766,379; with English language concise explanation.

An Office Action; "Notification of Reasons for Refusal," issued by the Japanese Patent Office on Feb. 4, 2014, which corresponds to Japanese Patent Application No. 2012-037547 and is related to U.S. Appl. No. 13/766,379; with English language translation.

* cited by examiner

ELECTRONIC COMPONENT AND METHOD OF MANUFACTURING THE SAME

CROSS REFERENCE TO RELATED APPLICATIONS

The present application claims priority to Japanese Patent Application No. 2012-037547 filed on Feb. 23, 2012, the entire contents of this application being incorporated herein by reference in its entirety.

TECHNICAL FIELD

The technical field relates to electronic components and methods of manufacturing the electronic components. More specifically, the technical field relates to electronic components including a multilayer body formed by stacking a plurality of insulating layers, and to methods of manufacturing the electronic components.

BACKGROUND

Examples of known existing electronic components include an electronic component disclosed in Japanese Unexamined Patent Application Publication No. 2000-236157. In the electronic component disclosed in Japanese Unexamined Patent Application Publication No. 2000-236157, a plurality of insulating layers are stacked on an insulating substrate. A plurality of helical coil conductors are stacked together with the insulating layers. Via hole conductors extending through the insulating layers connect the plurality of the helical coil conductors to one another. The electronic component disclosed in Japanese Unexamined Patent Application Publication No. 2000-236157 is manufactured using a photolithography method.

SUMMARY

The present disclosure provides an electronic component in which the occurrence of disconnections between line conductor layers and via hole conductor can be suppressed and a method of manufacturing the electronic component.

An electronic component according to an embodiment of the present disclosure includes: a multilayer body formed by stacking a plurality of insulating layers including a first insulating layer and a second insulating layer; a conductor layer provided on the first insulating layer; a line conductor layer provided on the second insulating layer, which is provided on an upper side of the first insulating layer in a stacking direction; and a via hole conductor that connects an end portion of the line conductor layer to the conductor layer and that extends through the second insulating layer in the stacking direction. In the via hole conductor, a connection surface connected to the line conductor layer is formed of a circular portion and a protrusion. The protrusion protrudes from the circular portion in a first direction in which the line conductor layer extends from the end portion.

A method of manufacturing the electronic component described above includes: forming the first insulating layer; forming the conductor layer on the first insulating layer; forming, on the conductor layer, the second insulating layer in which the via hole connected to the conductor layer is formed; and forming the via hole conductor by filling a conductor into the via hole and forming the line conductor layer on the second insulating layer, using a photolithography method. In the forming of the second insulating layer, the via hole conductor having an upper end surface formed of a circular portion and a protrusion protruding from the circular portion in the first direction is formed.

Embodiments according to the present disclosure can suppress the occurrence of disconnections between line conductor layers and via hole conductor layers.

DETAILED DESCRIPTION

Figure 11:
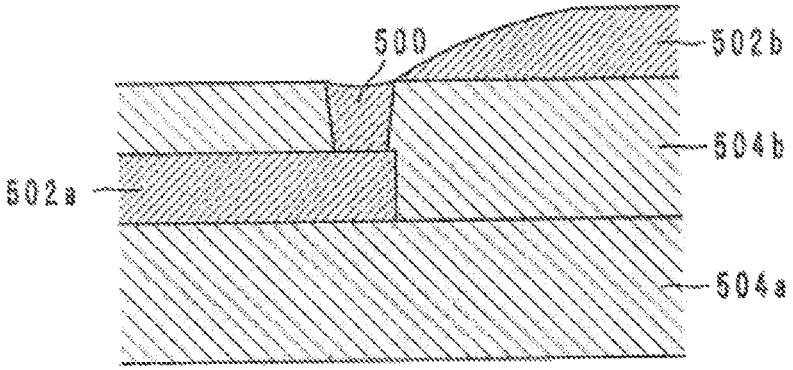
FIG. 11 is a sectional structure diagram of a via hole conductor, coil conductor patterns, and insulating layers.

The inventors realized that in the electronic component disclosed in Japanese Unexamined Patent Application Publication No. 2000-236157, disconnections may occur between the via hole conductors and the coil conductor patterns. FIG. 11 is a sectional structure diagram of a via hole conductor 500, coil conductor patterns 502*a* and 502*b*, and insulating layers 504*a* and 504*b*.

The coil conductor pattern 502*a* is provided on the insulating layer 504*a*. The insulating layer 504*b* is provided on the coil conductor pattern 502*a* and the insulating layer 504*a*. The coil conductor pattern 502*b* is provided on the insulating layer 504*b*. The via hole conductor 500 extends through the insulating layer 504*b* in the stacking direction and connects the coil conductor pattern 502*a* and the coil conductor pattern 502*b*.

The via hole conductor 500 and the coil conductor pattern 502*b* described above are formed using a photolithography method. The via hole conductor 500 and the coil conductor pattern 502*b* shrink when the via hole conductor 500 and the coil conductor pattern 502*b* are dried. In particular, a portion at which the via hole conductor 500 and the coil conductor pattern 502*b* are connected to each other, which has a larger volume than other portions, considerably shrinks. As a result, the via hole conductor 500 shrinks in the thickness direction of the insulating layer 504*b* and, hence, becomes thinner than the insulating layer 504*b*. Consequently, disconnections may occur between the coil conductor pattern 502*a* and the via hole conductor 500 and between the via hole conductor 500 and the coil conductor pattern 502*b*.

Hereinafter, an electronic component and a method of manufacturing the electric component according to exemplary embodiments of the present disclosure that can address the above-described shortcoming will now be described with reference to the figures.

Figure 1:
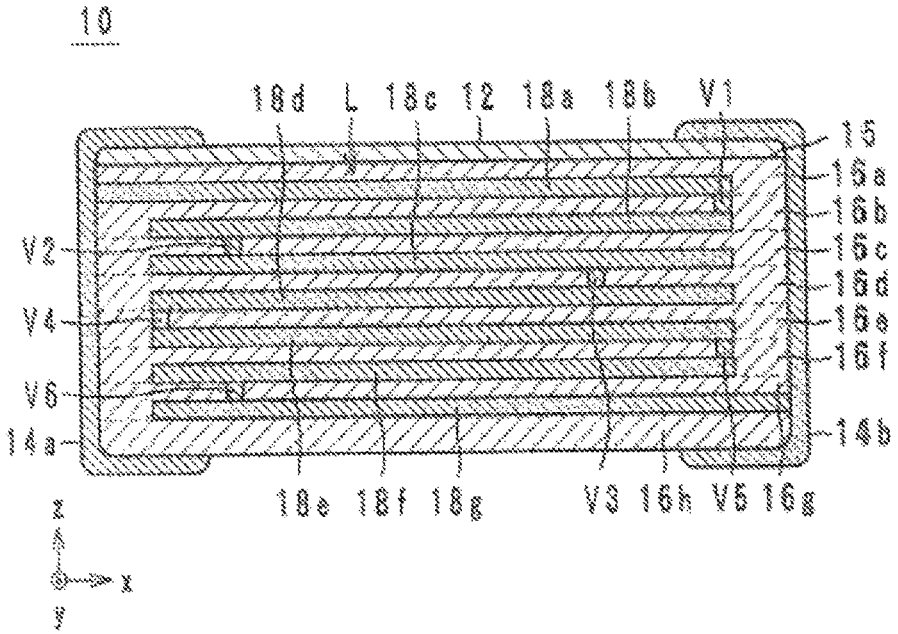
FIG. 1 is a transparent view of an electronic component according to an exemplary embodiment.

FIG. 1 is a transparent view of an electronic component 10 according to a first exemplary embodiment. Hereinafter, the stacking direction of the electronic component 10 is defined as the z-axis. When viewed in plan from the z-axis direction, the direction in which the long sides of the electronic component 10 extend is defined as the x-axis direction, and the direction in which the short sides of the electronic component 10 extend is defined as the y-axis direction. Hereinafter, viewing in plan from the positive z-axis direction is simply expressed as viewing in plan from the z-axis direction.

As illustrated in FIG. 1, the electronic component 10 includes a multilayer body 12, external electrodes 14 (14*a*, 14*b*), and a coil L.

The multilayer body 12 is shaped like a rectangular parallelepiped, and is formed by stacking rectangular insulating layers 15 and 16*a* to 16*h* (16) in this order from the positive z-axis direction side to the negative z-axis direction side, as illustrated in FIG. 1. The insulating layer 15 is stacked on furthest toward the positive side in the z-axis direction and is a surface marker layer having a marker formed thereon indicating the orientation of the multilayer body.

The coil L includes coil conductor layers 18*a* to 18*g*, sometimes collectively referred to herein as coil conductor layers 18, and via hole conductors V1 to V6, sometimes collectively referred to herein as via hole conductors V. The coil conductor layers 18*a* to 18*g*, which are respectively provided on the insulating layers 16*b* to 16*h*, are line conductor layers revolving around the respective intersections of the diagonals of the insulating layers 16*b* to 16*h*, when viewed in plan from the z-axis direction.

A first end of the coil conductor layer 18*a* extends to the negative x-axis direction side end surface of the multilayer body 12. A second end of the coil conductor layer 18*g* extends to the positive x-axis direction side end surface of the multilayer body 12.

The via hole conductors V1 to V6 respectively extend through the insulating layers 16*b* to 16*g* in the z-axis direction and connect the corresponding ends of the coil conductor layers 18*a* to 18*g* that neighbor one another in the z-axis direction. In more detail, the via hole conductor V1 connects the second end of the coil conductor layer 18*a* to a first end of the coil conductor layer 18*b*. The via hole conductor V2 connects the second end of the coil conductor layer 18*b* to a first end of the coil conductor layer 18*c*. The via hole conductor V3 connects the second end of the coil conductor layer 18*c* to a first end of the coil conductor layer 18*d*. The via hole conductor V4 connects the second end of the coil conductor layer 18*d* to a first end of the coil conductor layer 18*e*. The via hole conductor V5 connects the second end of the coil conductor layer 18*e* to a first end of the coil conductor layer 18*f*. The via hole conductor V6 connects the second end of the coil conductor layer 18*f* to the first end of the coil conductor layer 18*g*. The coil L formed in the manner described above extends in the z-axis direction in a helical shape.

The external electrode 14*a* covers the negative x-axis direction side end of the multilayer body 12, and is connected to the first end of the coil conductor layer 18*a*. The external electrode 14*b* covers the positive x-axis direction side end of the multilayer body 12, and is connected to the second end of the coil conductor layer 18*g*. As a result, the coil L is connected between the external electrodes 14*a* and 14*b*.

Figure 2:
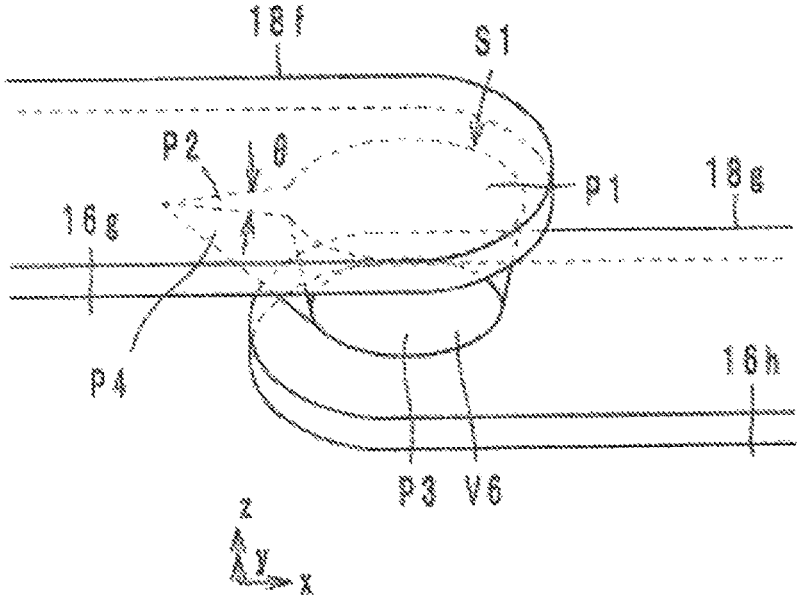
FIG. 2 is a perspective view of coil conductor layers and a via hole conductor.

The electronic component 10 has a configuration described below in order to suppress the occurrence of disconnections between the coil conductor layers 18 and the via hole conductors V. The via hole conductor V6 will be described below as an example. FIG. 2 is a perspective view of the coil conductor layers 18*f* and 18*g* and the via hole conductor V6.

The insulating layer 16*g* (second insulating layer) is stacked on the positive z-axis direction side of the insulating layer 16*h* (first insulating layer). The coil conductor layer 18*g* (conductor layer) is provided on the insulating layer 16*h*. The coil conductor layer 18*g* extends in the x-axis direction. The coil conductor layer 18*f* (line conductor) is provided on the insulating layer 16*g*. The coil conductor layer 18*f* extends in the x-axis direction. The first end of the coil conductor layer 18*g* and the second end of the coil conductor layer 18*f* are superposed with each other when viewed in plan from the z-axis direction.

The via hole conductor V6 connects the second end of the coil conductor layer 18*f* to the first end of the coil conductor layer 18*g*, and extends through the insulating layer 16*g* in the z-axis direction. Hereinafter, a surface of the via hole conductor V6 connected to the coil conductor layer 18*f* is called a connection surface S1.

The connection surface S1 is formed of a circular portion P1 and a protrusion P2. The circular portion P1 is shaped like a circle when viewed in plan from the z-axis direction. The protrusion P2, when viewed in plan from the z-axis direction, protrudes from the circular portion P1 in a direction in which the coil conductor layer 18*f* extends from the second end of the coil conductor layer 18*f* (i.e., the negative x-axis direction). The protrusion P2 is shaped like a triangle. The angle θ of the apex of the protrusion P2 is preferably between 15 degrees and 60 degrees inclusive. The optimal value of the angle θ is 30 degrees.

As a result of the connection surface S1 being formed of the circular portion P1 and the protrusion P2, the via hole conductor V6 has the shape of a protrusion P4 combined with a truncated cone P3. The truncated cone P3 has a shape whose diameter becomes smaller from the positive z-axis direction side to the negative z-axis direction side. The protrusion P4 has the shape of a triangular pyramid in which the amount of protrusion from the truncated cone P3 becomes smaller from the positive z-axis direction side to the negative z-axis direction side. In the embodiment shown in FIG. 2, protrusion protrudes from the circular portion towards a first direction in which the coil conductor layer 18*f* extends from its end portion. More particularly, a straight line passing through a center of the circular portion P1 and a midpoint of a width of the protrusion P2 is substantially parallel with the direction in which conductor 18*f* extends from an end portion of conductor 18*f* where the via hole conductor V6 is positioned.

Note that since the via hole conductors V1 to V5 can have the same shape as the via hole conductor V6, description thereof is not provided as it can be understood from the above description.

Figure 7:
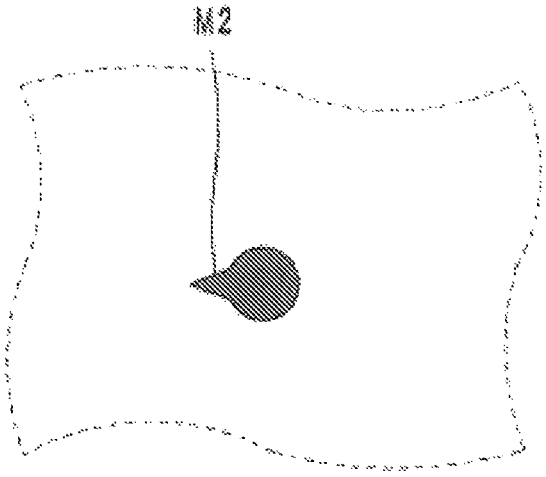
FIG. 7 is a diagram illustrating a photo mask.
Figure 8:
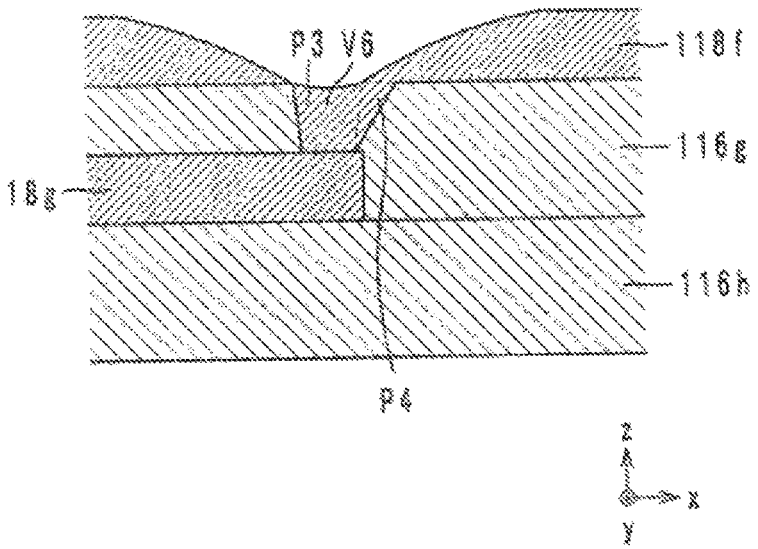
FIG. 8 is a process diagram illustrating the details of a process step illustrated in FIG. 5A.

Hereinafter, an exemplary method of manufacturing the electronic component 10 will be described with reference to the figures. FIGS. 3A to 6C are sectional process diagrams for illustrating manufacture of the electronic component 10. FIG. 7 is a diagram illustrating a photo mask M2. FIG. 8 is a sectional process diagram illustrating the process step of FIG. 5A in detail.

Figure 3A:
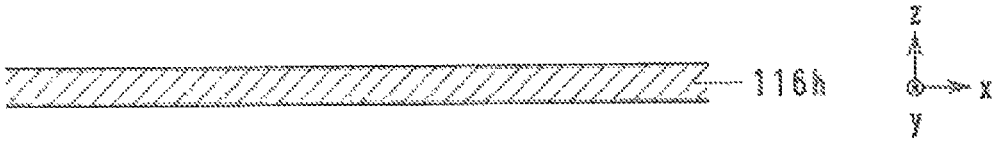
FIGS. 3A to 3D are sectional process diagrams for illustrating manufacture of the electronic component.

First, an insulating layer 116*h* is formed using a photolithography method. Specifically, as illustrated in FIG. 3A, the insulating layer 116*h* is formed by application of a photosensitive insulating material (e.g., a photosensitive resin including glass powder) using a printing method. At this time, the insulating layer 116*h* is formed in such a manner that the insulating layer 116*h* after sintering has a thickness of 10 μm. After that, the insulating layer 116*h* is dried.

Figure 3B:
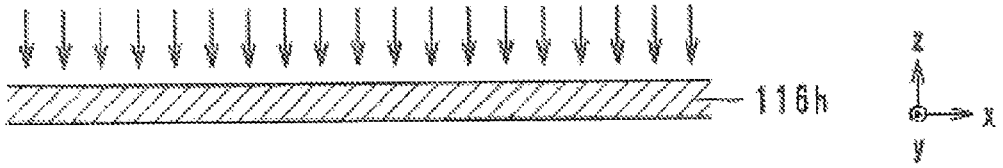

Next, as illustrated in FIG. 3B, the insulating layer 116*h* is subjected to exposure, whereby the insulating layer 116 is hardened. Through the process steps illustrated in FIG. 3A and FIG. 3B, the insulating layer 116*h* is formed.

Figure 3C:
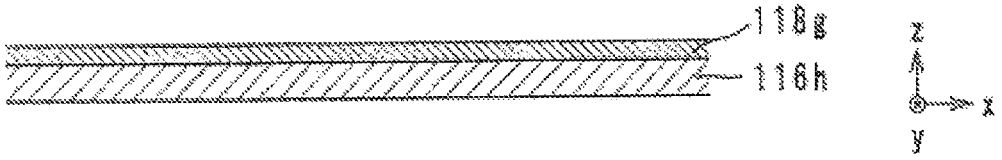

Next, the coil conductor layer 18*g* is formed on the insulating layer 116*h* using, for example, a photo lithography method. Specifically, as illustrated in FIG. 3C, a conductor layer 118*g* is formed by applying a photosensitive conductive material over the whole surface of the insulating layer 116*h* using a printing method. At this time, the conductor layer 118*g* is formed in such a manner that the coil conductor layer 18*g* after sintering has a thickness of 8 μm. After that, the conductor layer 118*g* is dried. Although not illustrated, the conductor layer 118*g* shrinks while being dried. The shrinking ratio of the conductor layer 118*g* is between 0.6 and 0.9 inclusive. Here, the shrinking ratio of the conductor layer 118*g* is a value obtained by dividing the volume of the conductor layer 118*g* after having been dried by the volume of the conductor layer 118*g* before being dried.

Figure 3D:
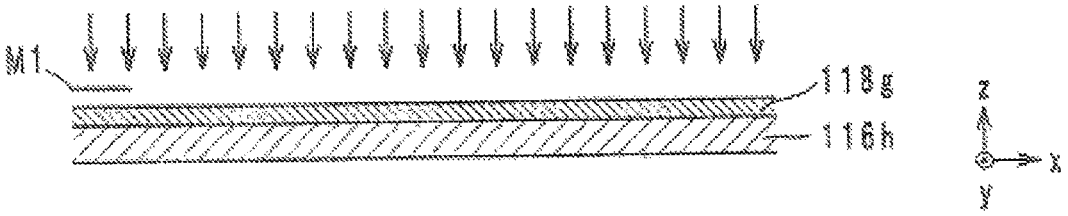

Next, as illustrated in FIG. 3D, the conductor layer 118*g* is subjected to exposure using a photo mask M1 which allows light to pass through only a portion thereof corresponding to the coil conductor layer 18*g*. As a result, only a portion of the conductor layer 118*g* corresponding to the coil conductor layer 18*g* is hardened.

Figure 4A:
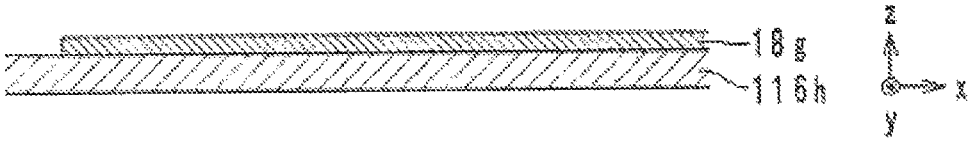
FIGS. 4A to 4D are sectional process diagrams for illustrating manufacture of the electronic component.

Next, a portion of the conductor layer 118*g* which has not been hardened is removed using a developing solution. As a result, the coil conductor layer 18*g* is developed, as illustrated in FIG. 4A. Through the process steps illustrated in FIG. 3C, FIG. 3D, and FIG. 4A, the coil conductor layer 18*g* is formed.

Figure 4B:
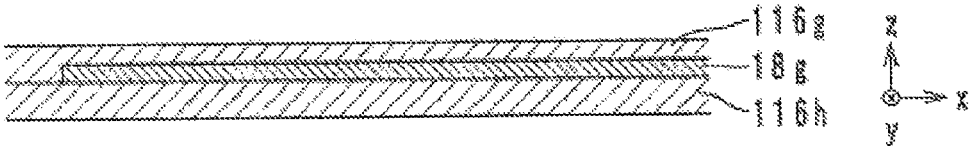

Next, an insulating layer 116*g* in which a via hole h6 connected to the coil conductor layer 18*g* is formed is formed on the coil conductor layer 18*g* using a photolithography method. Specifically, as illustrated in FIG. 4B, an insulating layer 116*g* is formed by applying a photosensitive insulating material over the whole exposed surfaces of the insulating layer 116*h* and the coil conductor layer 18*g* using a printing method. After that, the insulating layer 116*g* is dried.

Figure 4C:
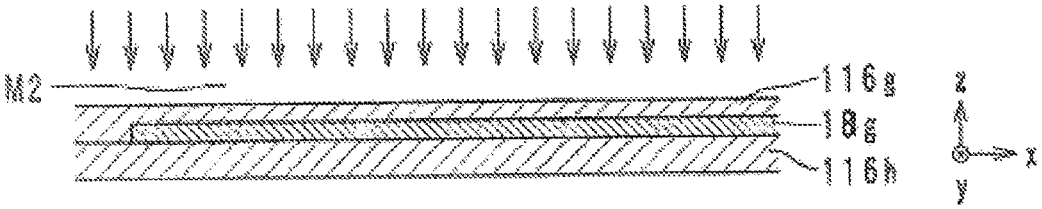
Figure 4D:
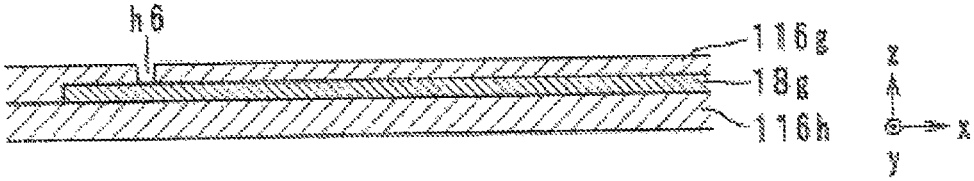

Next, as illustrated in FIG. 4C, the insulating layer 116*g* is subjected to exposure using the photo mask M2 that does not allow light to pass therethrough only at a portion where the via hole conductor V6 is to be formed, thereby hardening the insulating layer 116*g*. As illustrated in FIG. 7, the photo mask M2 is made in such a manner that a Cr plating portion having the same shape as the connection surface S1 of the via hole conductor V6 is formed on a transparent plate, such as a glass plate. As a result, the insulating layer 116*g* excluding a portion thereof where the via hole conductor V6 is to be formed is hardened.

Next, a portion of the insulating layer 116*g* which has not been hardened is removed using a development solution. As a result, referring to FIG. 4D, the via hole h6 is formed in the insulating layer 116*g*. Note that as a result of using the photo mask M2 illustrated in FIG. 7, the top end of the via hole h6 is formed of a circular portion and a protrusion protruding from the circular portion in the negative x-axis direction. Further, the via hole h6 becomes thinner, or has decreasing area in the x-axis and y-axis plane in the negative z-axis direction. This is because, in the process illustrated in FIG. 4D, it becomes harder for a development solution to reach a deeper portion of the insulating layer 116*g*. Through the process steps illustrated in FIG. 4B to 4D, the insulating layer 116*g* is formed.

Figure 5A:
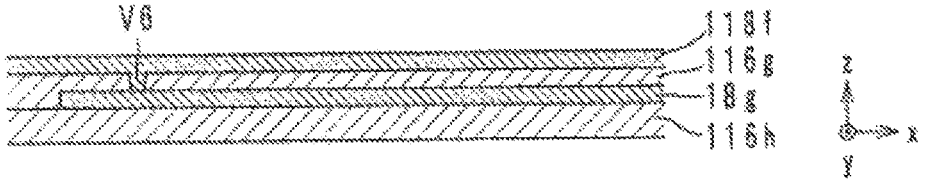
FIGS. 5A to 5D are sectional process diagrams for illustrating manufacture of the electronic component.

Next, using a photolithography method, the via hole h6 is filled with a conductor, thereby forming the via hole conductor V6 having a diameter of 50 μm, and the coil conductor layer 18*f* is formed on the insulating layer 116*g*. Specifically, as illustrated in FIG. 5A, a conductor layer 118*f* made of a photosensitive conductive material is applied over the whole surface of the insulating layer 116*g* using a printing method. After that, the conductor layer 118*f* is dried. As illustrated in FIG. 8, the conductor layer 118*f* and the via hole conductor V6 shrink while being dried. In particular, the via hole conductor V6, which has a larger volume per unit area when viewed in plan than the rest of the conductor layer 118*f*, considerably shrinks. However, the connection surface S1 of the via hole conductor V6 is formed of the circular portion P1 and the protrusion P2. Hence, the via hole conductor V6 has the shape of the protrusion P4 combined with the truncated cone P3, as a result of the connection surface S1 being formed of the circular portion P1 and the protrusion P2. Consequently, even when the via hole conductor V6 shrinks, since the protrusion P4 is shaped like a triangular pyramid, the volume gradually decreases in the protruding direction and, hence, the degree of shrinkage due to drying also gradually decreases. In other words, the degree of shrinkage of the protrusion P4 gradually decreases in the protruding direction. Hence, connection between the via hole conductor V6 and the conductor layer 118*f* is maintained, and disconnection is prevented from occurring.

Figure 5B:
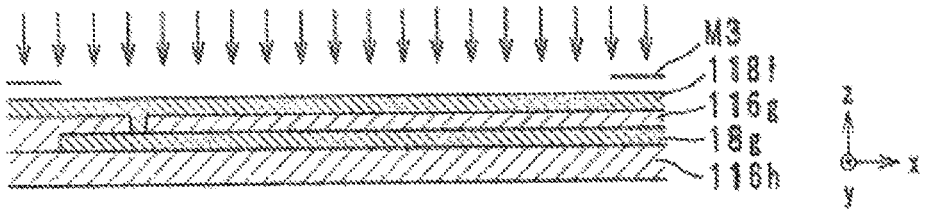

Next, as illustrated in FIG. 5B, the conductor layer 118*f* is subjected to exposure using a photo mask M3 which allows light to pass through a portion thereof corresponding to the coil conductor layer 18*f*. As a result, only a portion of the conductor layer 118*f* corresponding to the coil conductor layer 18*f* is hardened.

Figure 5C:
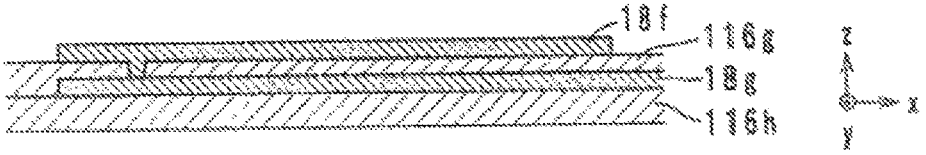

Next, a portion of the conductor layer 118*f* which has not been hardened is removed using a development solution. As a result, the coil conductor layer 18*f* is developed as illustrated in FIG. 5C.

Figure 5D:
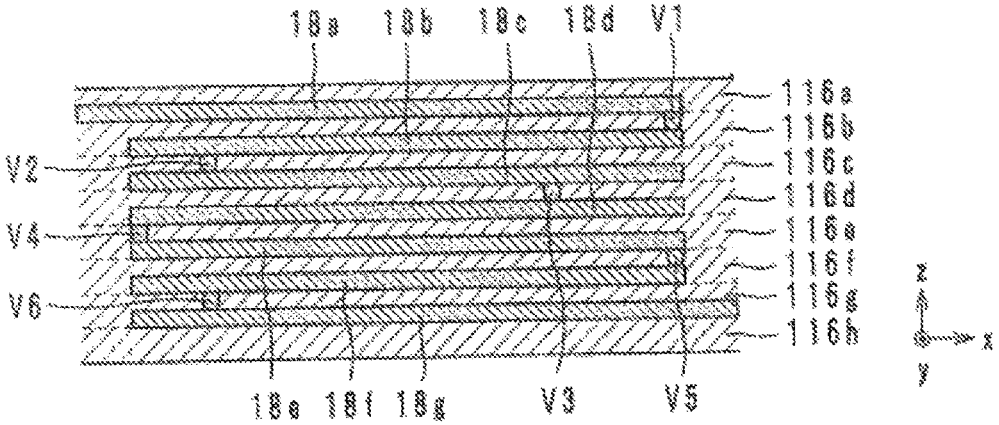

After that, by repeating the process steps illustrated in FIG. 4B to FIG. 5C, insulating layers 116*a* to 116*f*, the coil conductor layers 18*a* to 18*e*, and the via hole conductors V1 to V5 are formed, as illustrated in FIG. 5D.

Figure 6A:
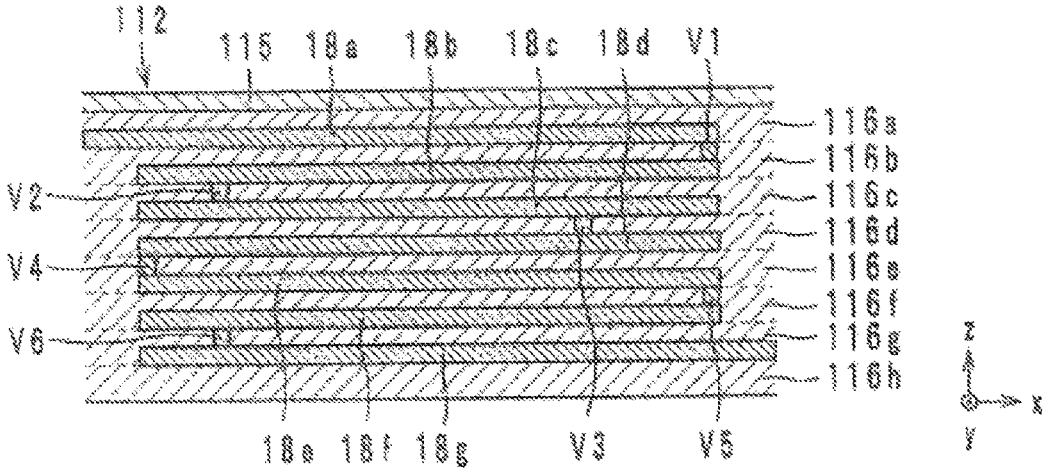
FIGS. 6A to 6C are sectional process diagrams for illustrating manufacture of the electronic component.

Next, as illustrated in FIG. 6A, an insulating layer 115 made of a photoconductive material is applied using a printing method. Then, the insulating layer 115 is dried. As a result, a mother multilayer body 112 is obtained.

Figure 6B:
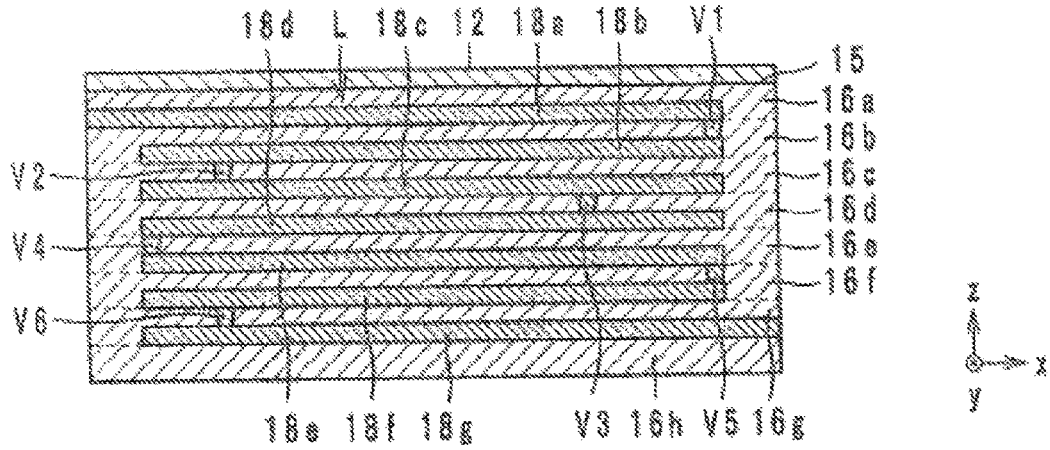

Next, as illustrated in FIG. 6B, a plurality of multilayer bodies 12 are obtained by cutting the mother multilayer body 112 using a dicer or the like. Note that the mother multilayer body 112 is cut in such a manner that the multilayer bodies 12 each having a size of 0.3 mm×0.3 mm×0.6 mm are obtained after sintering. After that, the multilayer bodies 12 are sintered at a predetermined temperature.

Figure 6C:
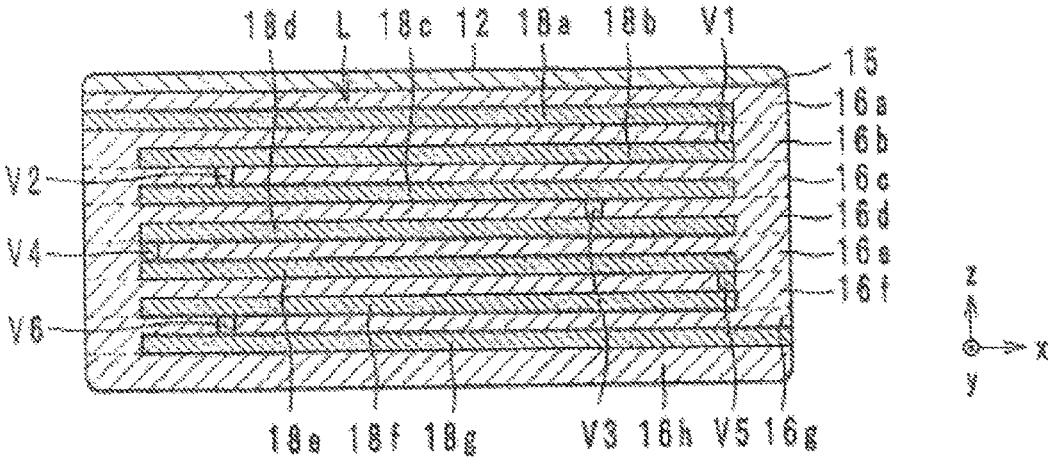

Next, as illustrated in FIG. 6C, the multilayer bodies 12 are subjected to barrel finishing, whereby the edges of the multilayer bodies 12 are chamfered.

Finally, as illustrated in FIG. 1, the external electrodes 14*a* and 14*b* are formed. Specifically, underlying electrodes are formed by applying conductive paste made of Ag. The external electrodes 14*a* and 14*b* are formed by plating the underlying electrodes with Ni and Sn. Through the process steps described above, the electronic component 10 is manufactured.

The electronic component 10 configured as described above and the method of manufacturing the electronic component 10 allow for suppression of the occurrence of disconnections between the coil conductor layers 18 and the via hole conductors V. In more detail, as illustrated in FIG. 8, the conductor layer 118*f* and the via hole conductor V6 shrink while being dried. In particular, the via hole conductor V6 considerably shrinks since the volume per unit area is large when the conductor layer 118*f* is viewed in plan.

Hence, the connection surface S1 of the via hole conductor V6 is formed of the circular portion P1 and the protrusion P2.

The protrusion P2 protrudes in a direction in which the coil conductor layer 18*f* obtained by developing the conductor layer 118*f* extends. As a result, the via hole conductor V6 has the shape of the protrusion P4 combined with the truncated cone P3. Hence, even when the conductor layer 118*f* shrinks, connection between the protrusion P4 and the conductor layer 118*f* can be maintained. Consequently, disconnection between the conductor layer 118*f* and the via hole conductor V6 can be prevented from occurring.

In the electronic component 10, the angle θ of the apex of the protrusion P2 is preferably between 15 degrees and 60 degrees inclusive. As a result of the angle θ being 15 degrees or more, a developing solution is allowed to easily penetrate into the protrusion P4, and the protrusion P4 shaped like a triangular pyramid having a sufficiently large size is formed. As a result of the angle θ being 60 degrees or less, the diameter of the via hole conductors V is prevented from becoming too large. When the angle θ is larger than 60 degrees, a developing solution penetrates into the protrusion P4 too much and the protrusion P4 becomes too large. In this case, the length of the protrusion P4 becomes too large and the protrusion P4 may protrude from the coil conductor layer 18 and come in contact with another coil conductor layer 18. Hence, it is preferable that the angle θ be 60 degrees or less. Note that the optimal value of the angle θ is 30 degrees.

Although ways of suppressing disconnection may include forming the coil conductor layers 18 in such a manner as to have a large thickness in advance, when the ratio of the thickness of the insulating layers 16 in the z-axis direction to the thickness of the coil conductor layers 18 in the z-axis direction is 1.0 or less, the thickness of the insulating layers 16 in the z-axis direction becomes small. Hence, the distance between the coil conductor layers 18 becomes small and stray capacitance between the coil conductor layers 18 becomes large. As a result, the Q characteristics of the coil of the electronic component 10 are degraded. Consequently, in the electronic component 10, it is preferable that the ratio of the thickness of the insulating layers 16 in the z-axis direction to the thickness of the coil conductor layers 18 in the z-axis direction be larger than 1.0.

It is preferable that the thickness of the conductor layers 118 in the z-axis direction before sintering be larger than or equal to 6 μm. This is because when the thickness of the conductor layers 118 in the z-axis direction before sintering is smaller than 6 μm, it is difficult to form the coil conductor layers 18.

Figure 9:
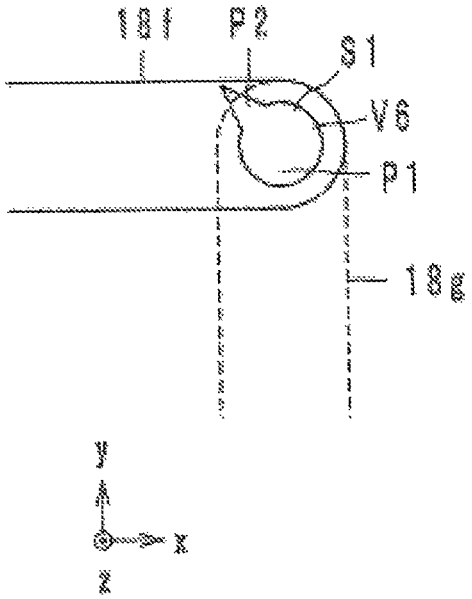
FIG. 9 is a diagram illustrating a via hole conductor and coil conductor layers according a modification.

Hereinafter, a via hole conductor V6 according to a first exemplary modification will be described with reference to the figures. FIG. 9 is a diagram illustrating the via hole conductor V6 and coil conductor layers 18*g* and 18*f* according to the first modification.

When the coil conductor layer 18*g* extends in the y-axis direction and the coil conductor layer 18*f* extends in the x-axis direction, the via hole conductor V6 is provided in a corner formed by the coil conductor layers 18*f* and 18*g*. In this case, the protrusion P2 may face in a slanting direction with respect to the x-axis direction. As can be seen in FIG. 9, the protrusion P2 faces towards a direction in which conductor 18*f* extends from an end portion of conductor 18*f*. However, it is required that the protrusion P2 do not protrude from the coil conductor layer 18*f* when viewed in plan from the z-axis direction and that the protrusion P2 form an acute angle with the negative x-axis direction. That is, it can be seen that a straight line passing through a center of the circular portion P1 and a midpoint of a width of the protrusion P2 (i.e., the apex) forms an acute angle with a longitudinal axis of the conductor 18*f*.

Figure 10:
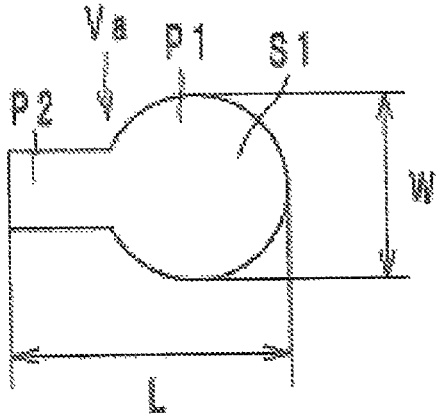
FIG. 10 is a diagram of a via hole conductor according to a second modification when viewed in plan from the z-axis direction.

Hereinafter, a via hole conductor Va according a second exemplary modification and a via hole conductor Vb according to a third exemplary modification will be described with reference to the figures. FIG. 10 is a diagram of the via hole conductor Va according to the second modification when viewed in plan from the z-axis direction.

As illustrated in FIG. 10, the protrusion P2 may be shaped like a rectangle. Furthermore, there may be a plurality of protrusions.

The electronic component 10 configured as described above and the manufacturing method are not limited to the electronic component 10 and the manufacturing method according to the embodiments described above, and various modifications are possible within the scope of the disclosure.

The dimensions of the electronic component 10 are exemplary, and not limited to those described in the embodiments. Examples of the dimensions of the electronic component 10 will be described below.

The size of the electronic component 10: 0.2 mm×0.2 mm×0.6 mm, 0.5 mm×0.5 mm×1.0 mm The thickness of the coil conductor layers 18: 6 μm-13 μm after sintering (8 μm-17 μm before sintering)

The thickness of the insulating layers 16: 7 μm-15 μm after sintering (9 μm-30 μm before sintering)

The diameter of the via hole conductors V: 20 μm-65 μm after sintering

As described above, embodiments consistent with the present disclosure are useful in electronic components and methods of manufacturing them, and in particular have an advantage in suppression of disconnections between line conductor layers and via hole conductor layers.

What is claimed is:

1. An electronic component comprising:

a multilayer body formed by stacking a plurality of insulating layers including a first insulating layer and a second insulating layer;

a conductor layer provided on the first insulating layer;

a line conductor layer provided on the second insulating layer, which is provided on an upper side of the first insulating layer in a stacking direction; and a via hole conductor that connects an end portion of the line conductor layer to the conductor layer and that extends through the second insulating layer in the stacking direction, wherein, in the via hole conductor, a connection surface connected to the line conductor layer is formed of a circular portion and a protrusion, and wherein the protrusion, when viewed in plan from the stacking direction, protrudes from a part of an outer edge of the circular portion towards a first direction in which the line conductor layer extends from the end portion, the protrusion, when viewed in plan from the stacking direction, has a triangular shape, and an angle of an apex of the protrusion is larger than or equal to 15 degrees and smaller than or equal to 60 degrees.

2. The electronic component according to claim 1, wherein an area of the protrusion in a plane perpendicular to the stacking direction decreases in the stacking direction from line conductor layer to the conductor layer.

3. The electronic component according to claim 1, wherein a straight line passing through a center of the circular portion and a midpoint of a width of the protrusion is substantially parallel with the first direction.

4. A method of manufacturing the electronic component according to claim 1, the method comprising:

forming the first insulating layer;

forming the conductor layer on the first insulating layer;

forming, on the conductor layer, the second insulating layer in which the via hole connected to the conductor layer is formed; and forming the via hole conductor by filling a conductor into the via hole and forming the line conductor layer on the second insulating layer, using a photolithography method, wherein, in the forming of the second insulating layer, the via hole conductor having an upper end surface formed of a circular portion and a protrusion protruding from the circular portion in the first direction is formed.

* * * * *